US011885140B2

(12) United States Patent
Domanico

(10) Patent No.: US 11,885,140 B2
(45) **Date of Patent: *Jan. 30, 2024**

(54) PREFABRICATED TILE STRIP

(71) Applicant: New Age Surfaces, LLC, Romeoville, IL (US)

(72) Inventor: Mark Domanico, Romeoville, IL (US)

(73) Assignee: New Age Surfaces, LLC., Romeoville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/502,815

(22) Filed: Oct. 15, 2021

(65) Prior Publication Data

US 2022/0213692 A1 Jul. 7, 2022

Related U.S. Application Data

(63) Continuation of application No. 16/549,771, filed on Aug. 23, 2019, now Pat. No. 11,149,440.

(60) Provisional application No. 62/722,011, filed on Aug. 23, 2018.

(51) Int. Cl.
*E04F 13/08* (2006.01)

(52) U.S. Cl.
CPC ..... *E04F 13/0862* (2013.01); *E04F 13/0885* (2013.01)

(58) Field of Classification Search
CPC ..... E04F 13/0862; E04F 13/0873; E04F 13/0885; E04F 13/142
See application file for complete search history.

(56) References Cited

U.S. PATENT DOCUMENTS 2,122,577 A * 7/1938 Mattes ..... E04F 13/147 52/541
3,362,119 A * 1/1968 Murphy ..... E04F 13/0862 52/309.8
3,445,972 A * 5/1969 Carr ..... E04F 13/0803 52/395
3,817,012 A * 6/1974 Wack ..... E04F 19/06 428/49
4,299,069 A * 11/1981 Neumann ..... E04C 2/30 52/309.4
4,916,875 A * 4/1990 Kashiwagi ..... E04F 13/0851 52/302.3

(Continued)

FOREIGN PATENT DOCUMENTS

DE 9213076 U1 * 1/1993
DE 29519411 U1 * 5/1996

*Primary Examiner* — Christine T Cajilig
(74) *Attorney, Agent, or Firm* — Erickson Law Group, PC

(57) ABSTRACT

A prefabricated tile strip includes a backing board, a tile region having plural tiles and grout. The grout can be composed of a resin/polymer-based grout that allows for superior water resistance, stain resistance, crack resistance and is transportable without breaking. The strip includes an edge region or flange on either side of the tiles to allow for simple screw in and glue on assembly, not even a wall is necessary, the strip can be attached directly to the studs. A step over/under water resistant edges can go directly onto a bathtub or shower ledge or onto the wet area of a tile floor (not separate ledge), allowing it to go straight down to the bottom of a shower floor, or It can step right over a thin plastic flange on a tub or shower base.

9 Claims, 4 Drawing Sheets

(56) References Cited

U.S. PATENT DOCUMENTS

| | | | | |
|---|---|---|---|---|
| 5,816,005 | A * | 10/1998 | Han | A47K 3/008 52/390 |
| 6,330,774 | B1 * | 12/2001 | Weinstein | A47B 77/022 52/391 |
| 10,870,313 | B2 * | 12/2020 | Lacasse-Veilleux | B44C 1/28 |
| 2005/0086736 | A1 * | 4/2005 | Helmetsie | A47K 3/281 4/596 |
| 2008/0313981 | A1 * | 12/2008 | Donley | E06B 9/04 52/203 |
| 2011/0094177 | A1 * | 4/2011 | Licciardi | E04F 13/142 52/582.1 |
| 2014/0053487 | A1 * | 2/2014 | Tatari | E04F 13/0862 52/386 |
| 2014/0331585 | A1 * | 11/2014 | Morneau | B29C 70/305 156/196 |
| 2015/0033656 | A1 * | 2/2015 | Geels | E04C 2/46 52/506.01 |
| 2015/0361673 | A1 * | 12/2015 | Rosko | E04F 13/185 264/225 |
| 2016/0160496 | A1 * | 6/2016 | Seckler | E04F 13/0898 52/272 |
| 2022/0185002 | A1 * | 6/2022 | Evangelisti | B44C 1/222 |

* cited by examiner

PREFABRICATED TILE STRIP

This application is a continuation of U.S. Ser. No. 16/549,771, filed Aug. 23, 2019, which claims the benefit of U.S. Provisional Application 62/722,011 filed Aug. 23, 2018.

BACKGROUND OF THE INVENTION

Prefabricated tile boards are known in prior patents but are not in widespread use in remodeling and new construction.

U.S. Pat. No. 6,330,774 describes tile panels with edge regions free for applying fasteners to mount the panels to framing studs. Each panel is fabricated using a flat rigid base member to which tiles are adhered with an adhesive and grouted. After the panels are fastened in the tile free regions, joints of adjoining panels are taped and then the tile-free edge regions are tiled over and grouted, concealing the fasteners.

U.S. Pat. No. 3,362,119 describes a prefabricated tile panel having a rigid base sheet of cement board, tiles adhesively mounted on the sheet, and grouted between tiles, and a deformable backing material composed of moisture proof foam board, over the back of the base sheet. Some tiles are left off to allow fastening adjacent panels to studs and then these locations are tiled over.

U.S. Pat. No. 8,887,462 describes a pre-fabricated tile system including modular extruded plastic backing boards including male/female edges for mating with an adjacent boards. Flat backing boards are not disclosed.

The present inventor has recognized that it would be desirable to provide a prefabricated tile strip that was durable, crack resistant, efficiently installed, and cost effectively manufactured.

SUMMARY

The exemplary embodiment of the invention provides a prefabricated tile strip that enhances installation, provides an improved aesthetic appearance and is cost effectively manufactured and installed.

The embodiment includes a preassembled strip of backing board, a tile region having plural tiles and grout. The grout can be composed of a resin/polymer-based grout that allows for superior water resistance, stain resistance, crack resistance and is transportable without breaking. The strip can have up to 5 layers of moisture protection. The strip includes an edge region or flange on either side of the tiles to allow for simple screw in and glue on assembly; not even a wall is necessary; the strip can be attached directly to the studs.

A step over/under water resistant edge can go directly onto a bathtub or shower ledge or onto the wet area of a tile floor (not separate ledge), allowing it to go straight down to the bottom of a shower floor, or it can step right over a thin plastic flange on a tub or shower base.

The strip is advantageously used with flat surface panels such as countertops, shower panels or tub wall panels. The tiles can be color coordinated with these flat surface panels. The use of ⅜ inch thick tiles, such as mosaic tile of real glass and stone, can allow for stronger support when transporting, and more practical when handling. The strip can have a water proof "step over" edge, allowing for the backing board to go over obstructions.

An aluminum tile edger can surround the tile region and can be used to avoid any unfinished perimeter, or to transition between substrates or panels.

A waterproof membrane can be used to cover the backing board. Adhesion promoters can be used on edges for construction adhesives (not just standard mortar). Antimicrobial protection can also be applied.

The membrane can cover all sides, can be thin and gives unique level of water resistance and mold protection, even letting the tile sit directly over a wet ledge and still avoid "wicking", where the tile backing board draws in water. These edges have a water resistant coating as well as an adhesion promoter that binds not only to mortar, but also common types of construction adhesives.

An antimicrobial agent for fighting mold and bacteria can be added to the backing board. Alternatively, the strips can be factory cut and finished with an anodized aluminum edge, which can be decorative and/or functional. Where necessary, a decorative tile edger can be used to avoid/minimize any unfinished perimeter.

The backing board can include a fiberglass-based front, making it resistant to moisture and mold. The backing board can be stiffer and stronger than conventional cement board.

The edge design is different in multiple ways, which affects both application options and an easier or more practical handling/installation.

Resin/polymer based grout, minimizes porosity, for maximum water, mold and stain resistance. Fluoro-chemical grout and stone sealant gives an added layer of moisture and stain protection.

Numerous other advantages and features of the present invention will be become readily apparent from the following detailed description of the invention and the embodiments thereof, and from the accompanying drawings.

DETAILED DESCRIPTION

Figure 1:
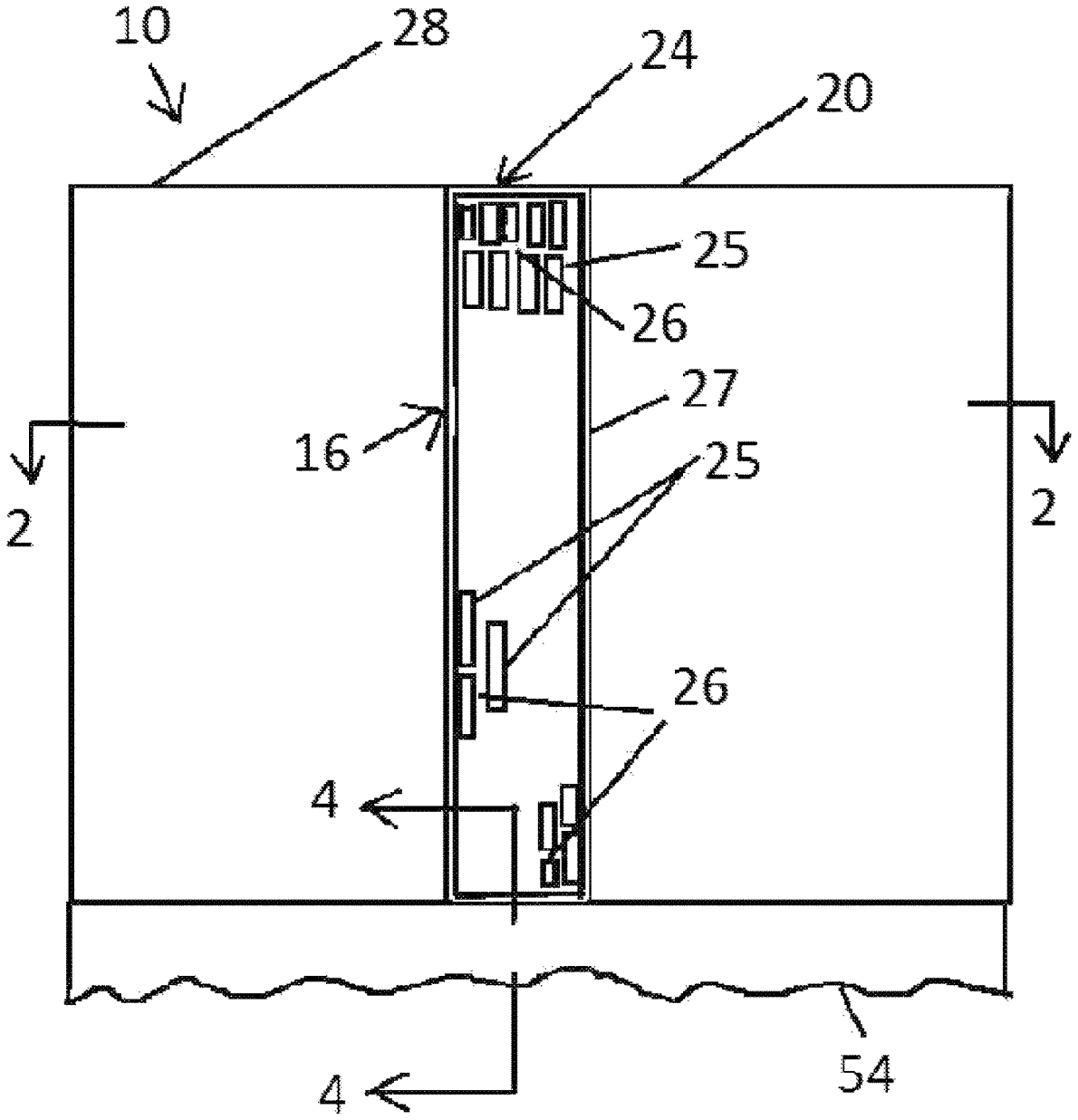
FIG. 1 is a fragmentary elevation view of an installation of an exemplary embodiment of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference U.S. Ser. No. 16/549,771, filed Aug. 23, 2019, and U.S. Provisional Application 62/722,011 filed Aug. 23, 2018 in their entireties.

FIG. 1 illustrates a wall assembly 10 mounted onto a bath or shower base 54. The assembly 10 includes a shower panel 20 and a shower panel 28 installed on either side of a tile panel 16. The panel 16 includes backing board 22 that carries a tiled region 24 on a front face thereof. The region 24 includes tiles 25 adhesively secured onto the backing board 22 and having grout 26 surrounding each tile 25. The grout can be a urethane based grout and then sealed with a group sealer. Even though only some tiles 25 are shown in the region 24, it should be understood that the entire region 24 can be substantially covered with tiles 25 and grout 26. An aluminum tile edger or frame 27 can be used around the tile region 24 to avoid any unfinished perimeter, or to transition between substrates or panels.

Figure 2:
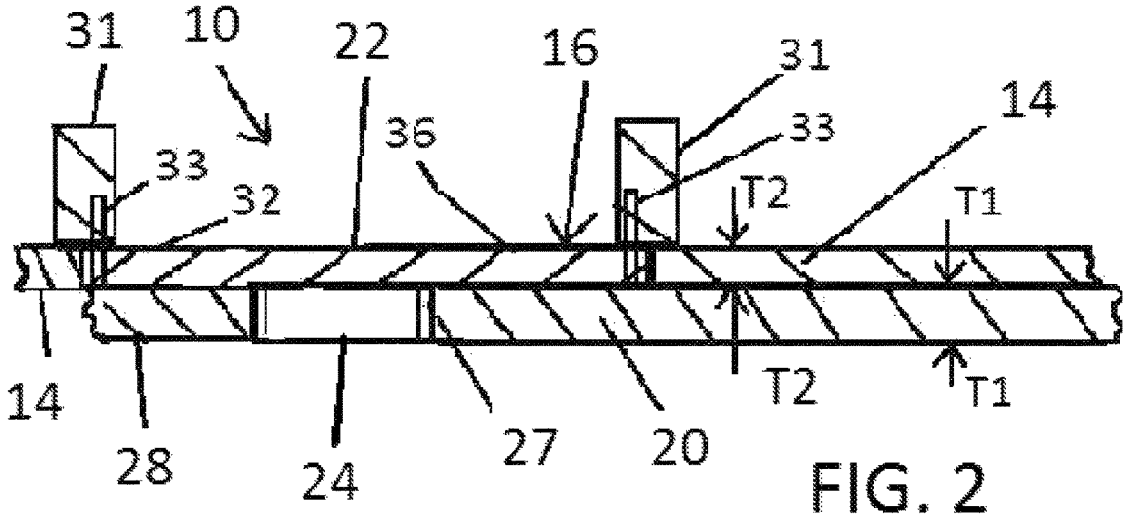
FIG. 2 is a sectional view taken generally along line 2-2 of FIG. 1.

As shown in FIG. 2, the backing board 22 can be fastened to studs 31 by nails 33 or other fasteners, and/or adhesive. Alternatively the backing board 22 can be adhesively secured to wall boards or green boards, not shown.

The tiles 25 advantageously have a thickness T1 of about ⅜ inch corresponding to a thickness of the shower panels 20, 28 to provide a continuous flush surface over the shower panels 20, 28 and the region 24. The backing board 22 can have a thickness T2 equal to adjacent wall boards 14.

Figure 3:
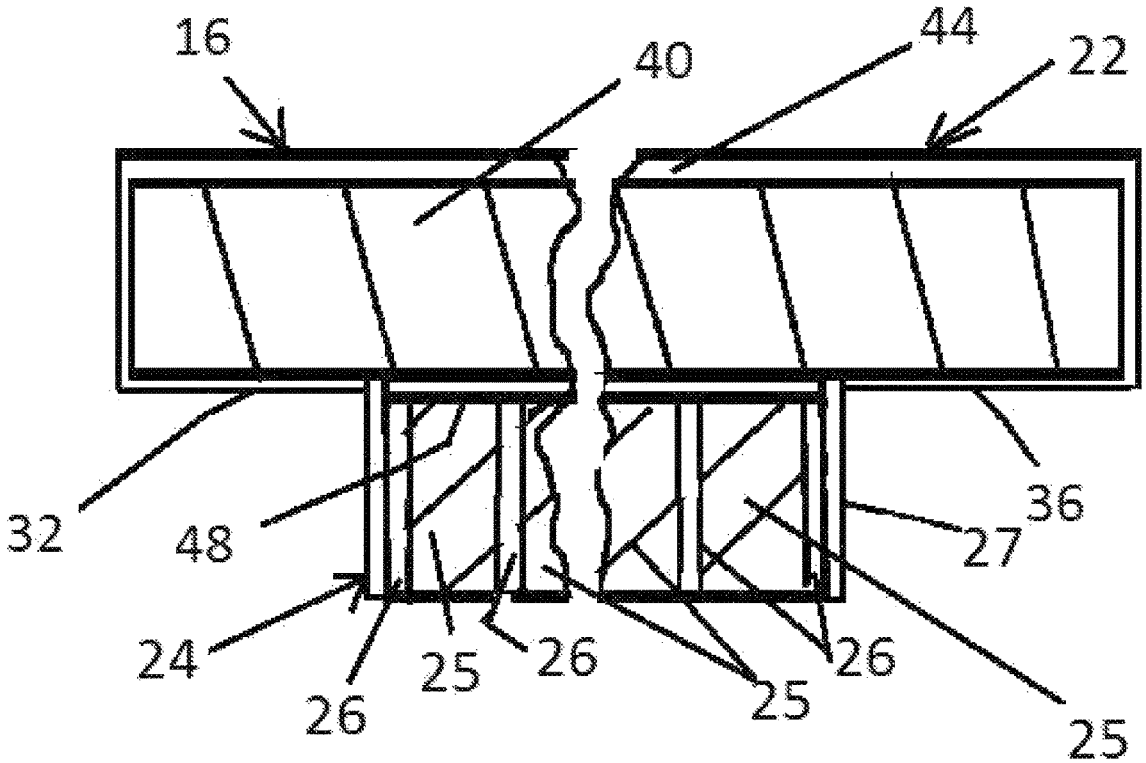
FIG. 3 is an enlarged sectional view of the exemplary embodiment taken from FIG. 2.

As shown in FIG. 3 the board 22 includes a base board 40, such as a DENSSHIELD Tile Backer, from Georgia-Pacific that is substantially covered by a sealing layer 44. The sealing layer 44 is composed of one thickly brushed-on layer of REDGARD waterproofing membrane, available from Custom Building Products Corporation of Seal Beach California. The tiles 25 (not drawn to scale) in the region 24 can be secured by an adhesive layer 48 to the backing board 22. The board 22 includes exposed side regions 32, 36, also covered by the layer 44 that provide edge regions or flanges for receiving the overlapping shower panels, or tiles or other coverings. The shower panels 20, 28 can be adhesively secured and sealed to the regions 32, 36.

The entire panel 16 can be factory preassembled with base board 40, sealing layer 44, adhesive 48, tiles 25, frame 27, grout 26 and grout sealer to be delivered to the job site for installation onto the studs or other structure.

Figure 4:
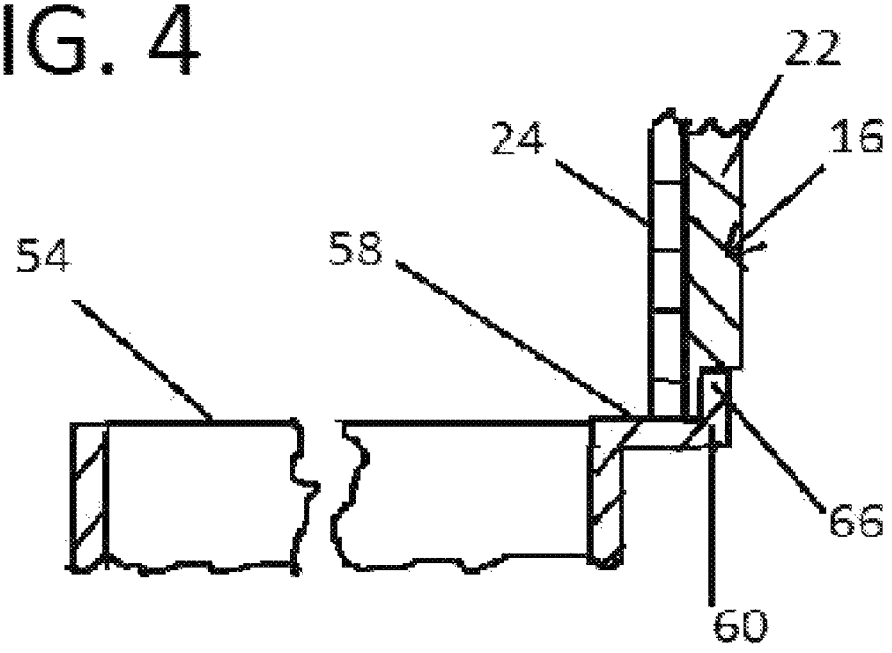
FIG. 4 is a fragmentary sectional view taken generally along line 4-4 of FIG. 1 illustrating a step over edge.
Figure 6:
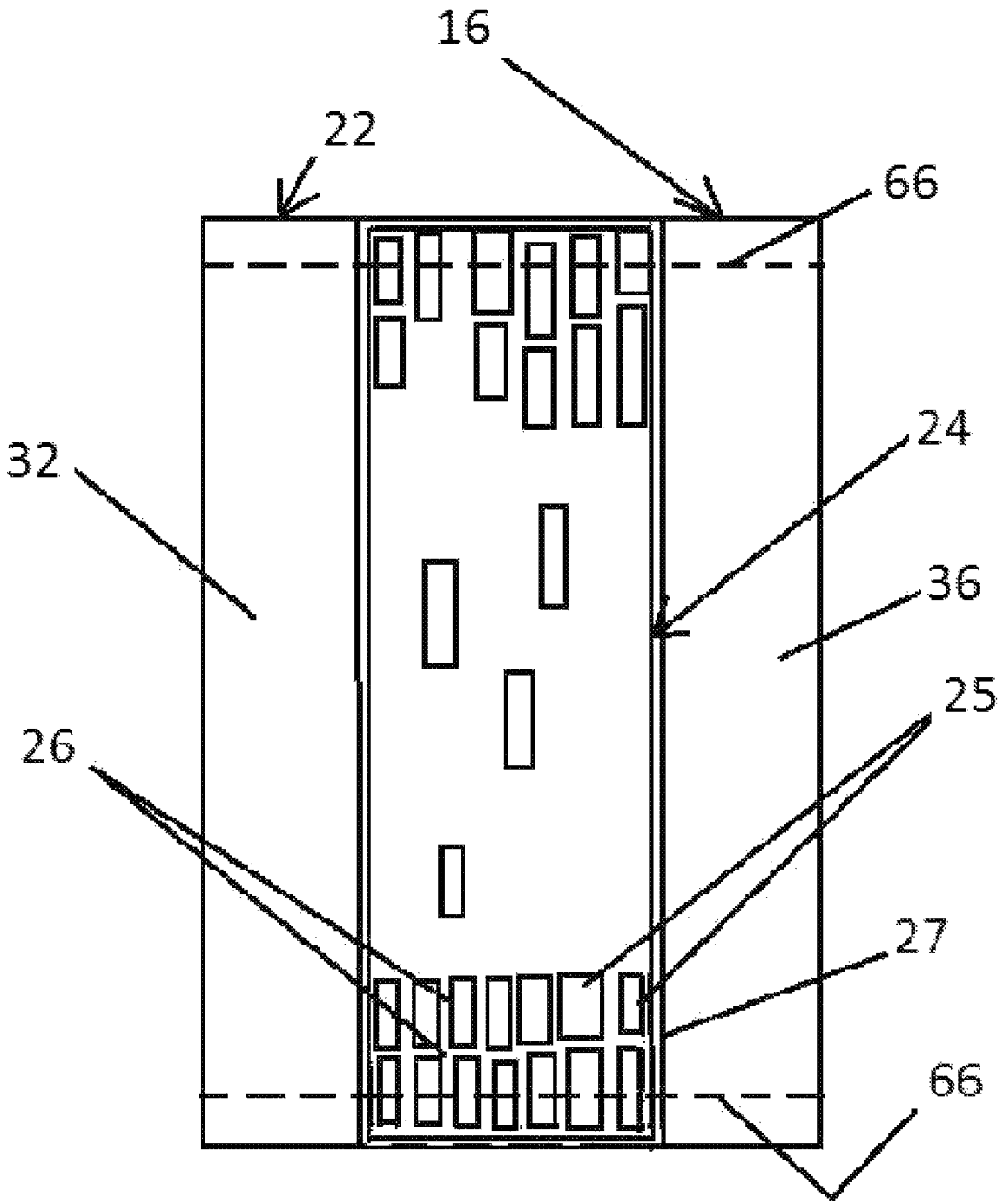
FIG. 6 is an elevational view of the exemplary embodiment of FIG. 1.

FIG. 4 illustrates the panel 16 mounted to a shelf 58 of a shower or tub base 54. The shelf 58 includes a vertical edge or rim 60. The backing panel 22 includes a rear step 66 that has a height and width sufficient to step over the vertical rim 60. With the step 66, the tile region 24 can be set down onto the shelf 58 or set closely to the shelf 58. The step 66 can be applied to only the bottom or to both the top and bottom as shown in FIG. 6. This allows for a top step over as needed.

Figure 5:
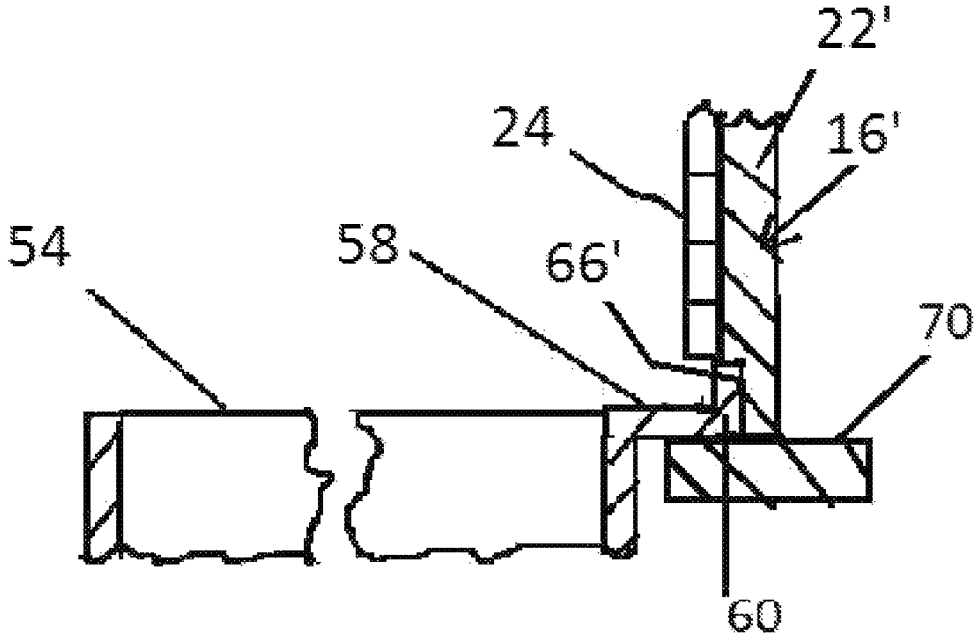
FIG. 5 is a fragmentary sectional view comparable to FIG. 4 but with a step under edge.

FIG. 5 illustrates an alternate embodiment panel 16' mounted to a shelf 58 of a shower or tub base 54. The shelf 58 includes a vertical edge or rim 60. The backing panel 22' includes a front step 66' that has a height and width sufficient to step under the vertical rim 60. With the step 66', the tile region 24 can be set down onto the rim 60 or close to the rim 60 and a bottom of the board 22 can be set onto an underlying structure 70. The step 66 can be applied to only the bottom or to both the top and bottom as shown in FIG. 6. This allows for a top step under or over as needed.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein, to the extent that the references are not contrary to the present disclosure.

The invention claimed is:

1. A decorative panel and tub or shower panel assembly, comprising:

a backing board; and a plurality of tiles secured to a central region of the backing board;

tub or shower panels, each having a flat region, and said panels located on opposite sides of the central region;

wherein the central region is sized to provide exposed regions of the backing board without tiles, on opposite sides of the central region, the exposed regions being attached to external structure;

wherein the tub or shower panels abut the central region on opposite sides and the respective flat regions overlap the exposed regions.

2. The decorative panel and tub or shower panel assembly according to claim 1, wherein the tiles have a thickness equal to adjacent shower panels or tub panels.

3. The decorative panel and tub or shower panel assembly according to claim 1, wherein the tiles are adhesively secured to the backing board and grout is applied between tiles.

4. A method of installing a decorative panel and shower or tub panels, comprising the steps of:

providing a backing board; and providing a plurality of tiles secured to a central region of the backing board;

wherein the central region is sized to provide exposed regions of the backing board without tiles, on opposite sides of the central region;

attaching the exposed regions to external structure;

overlapping the exposed regions with flat regions of adjacent shower panels or tub panels and securing the shower panels or tub panels to the exposed regions.

5. The method according to claim 4, wherein the tiles have a thickness equal to the adjacent shower panels or tub panels.

6. The decorative panel and tub or shower panel assembly according to claim 1 wherein the backing board is sealed on its front, back and sides with a sealing layer.

7. The decorative panel and tub or shower panel assembly according to claim 1, wherein the central region is surrounded by a frame.

8. The decorative panel and tub or shower panel assembly according to claim 1, wherein the backing board has a step formed on a back side of the backing board sized to step over a ledge.

9. The method according to claim 4, wherein the backing board having a step formed on a back side of the backing board; and installing the backing board with the step fitting over a ledge.

* * * * *